United States Patent [19]

Yerly

[11] Patent Number: 5,064,110

[45] Date of Patent: Nov. 12, 1991

[54] FIXTURE FOR FASTENING A STRIPPING, A BLANK SEPARATING OR A SIMILAR TOOL

[75] Inventor: Marcel Yerly, Jouxtens, Switzerland

[73] Assignee: Bobst SA, Switzerland

[21] Appl. No.: 592,367

[22] Filed: Oct. 3, 1990

[30] Foreign Application Priority Data

Oct. 3, 1989 [CH] Switzerland ..... 03605/89

[51] Int. Cl.[5] ..... B26D 7/18

[52] U.S. Cl. ..... 225/97; 83/700

[58] Field of Search ..... 225/97; 83/700; 403/393, 110

[56] References Cited

U.S. PATENT DOCUMENTS

| | | | |
|---|---|---|---|
| 1,198,186 | 9/1916 | Brown | 403/110 |
| 3,432,197 | 3/1969 | Albertine et al. | 403/110 |
| 3,784,070 | 1/1974 | Vossen | 225/1 |
| 4,015,495 | 4/1977 | Yerly | 83/103 |
| 4,248,370 | 2/1981 | Schröter | 225/97 |
| 4,913,016 | 4/1990 | Frei | 83/103 |

FOREIGN PATENT DOCUMENTS 2815797 10/1979 Fed. Rep. of Germany .

*Primary Examiner*—Frank T. Yost
*Assistant Examiner*—John M. Husar
*Attorney, Agent, or Firm*—Hill, Van Santen, Steadman & Simpson

[57] ABSTRACT

A fastening device for securing a tool on an adjustable crossbar of a waste stripping and blank separating station of a sheet processing machine includes a tie bar provided with a headed end which receives a support for the tool part, a pair of clamping jaws, each of which is provided with a supporting surface designed to enter in contact with the crossbar of the stripping station and have additional supporting surfaces designed to enter into contact with one another. The second end of the tie bars carries a tightening arrangement which provides three positions including a substantial release of pressure on the jaws to enable fixing and dismantling of the tool, an intermediate amount of pressure on the jaws to allow shifting of the arrangement along the crossbar and a third amount of pressure which provides a tightening or locking of the tool in a given position on the crossbar.

11 Claims, 2 Drawing Sheets

FIXTURE FOR FASTENING A STRIPPING, A BLANK SEPARATING OR A SIMILAR TOOL

BACKGROUND OF THE INVENTION

The present invention is concerned with a device for fastening a stripping tool, a blank separator tool or a similar tool which is fitted on an adjustable crossbar of a waste stripping or blank separation station within a sheet processing machine.

U.S. Pat. No. 4,248,370, whose disclosure is incorporated by reference thereto and which claims priority from German Application 28 15 797, discloses a fastening device for securing a tool on a crossbar of a waste stripping or blank separating station within a sheet processing machine. The device includes a rod-shaped tie bar provided with a headed end which receives a freely shifting support for the tool, a first and second guide, each being provided at least with one supporting surface slanting with regard to the axis of the tie bar and constructed to act jointly with two corresponding guide surfaces on a crossbar of the station. Tightening means provided on one end of the tie bar and designed to push the sliding components toward the headed end of the tie bar in order to bring about a variation in their contact pressure enabling the execution of three operations, which include fitting and dismantling the tool, shifting the tool, and locking of various components with regard to one another on the crossbar.

In waste stripping stations of a sheet processing machine, for instance a press for die-cutting board sheets designed as packages, the state of the art consists in placing the die-cut sheet over a matrix plate which has a variety of apertures which are situated exactly underneath the various offal or waste cut outs for the sheet. The waste is then to be separated from the sheet, since it is not to be part of the finished product. To accomplish this, the bits of waste are to be put in contact with the strippers, which have, for the purpose to act on the waste in such a way as to detach it completely from the sheet and to push or eject it through the corresponding apertures or openings in the matrix plate.

Up to now, several solutions have been proposed for fastening the various strippers opposite the corresponding bits of waste. For example, as disclosed in U.S. Pat. No. 3,784,070, which is incorporated by reference thereto and which claims priority from German Application P 21 58 907.1, the die-cut sheet arrives in a station which is designed for ejecting the waste from the die-cut sheet. The strippers are fitted so as to be shiftable on crossbars which are, themselves, shiftable on two frames situated above and below the matrix plate on which the die-cut sheet is to be laid in order to align the tools with the position of the waste that is to be removed from the die-cut sheet.

In this connection, it is to be pointed out that the sheet generally contains a great number of bits of waste to be ejected and that, consequently, the upper and lower frames are to be equipped with a correspondingly large number of stripping tools, which sometimes may be more than 100 tools.

According to the above-mentioned U.S. Pat. No. 4,248,370, there are two possibilities for relative shifting the tool to allow a positioning of the stripper pin exactly opposite the portion of waste to be removed. These are the shifting of the stripper support with regard to the two clamp-shaped guides and shifting the guides or clamps with regard to the crossbar. Attention is to be drawn to the fact that this method of fastening, which has the advantages of allowing by means of a single action on a screw head, a simultaneous achievement of two relative shifts has already simplified the positioning of the strippers referred to hereinabove. However, on account of the rather large number of strippers fitted in the stripper station, the positioning of the stripper remains fastidious, since the operator is compelled to screw in more or less every screw by means of a wrench, depending on whether he wants to carry out the three essential operations of fitting and dismantling, shifting and locking. The rate of tightening of the screw, as involved with the one or the other of the three operations, cannot be determined easily and exactly and absorbs much time, especially so with, say, about 100 stripping tools.

Another drawback might also be mentioned in this regard. For example, the fastening device is not easy to assemble to fit on the crossbar on account of the fact that the clamps are able to turn independently from one another on the tie bar and, thus, do not always have their supporting surface in parallelism with the guide surfaces of the crossbar, which causes their assembly to be awkward. The screw making up the tie bar might be insufficiently screwed in for locking if one of the clamps is misaligned. In the event a screw is not properly tightened with the clamp properly aligned, the clamp might slip off from the crossbar. The fitting and dismantling operations are almost always to be carried out by using both hands.

It might also happen that after being locked on the crossbar, the fastening device being skewed with regard to the lengthwise direction of the crossbar. When the machine operates, the vibrations have a tendency to realign the device which realignment will result in a diminished pre-stressing and to cause the device to drop, entailing serious damages on the installation.

It might also happen that the technician, hastily locking a great number of strippers, especially so on a high-performance machine, with excessive tightening of the screw of the fastening device and, therefore, cause the breakage of certain components. To avoid this hazard, the tightening strength applied must, therefore, be checked.

SUMMARY OF THE INVENTION

It is an object of the present invention to overcome the above-noted problems with the existing fastening devices for tools, such as stripper tools.

To accomplish these goals, the present invention is directed to an improvement in a device for fastening a tool, such as a stripping tool or a blank separating tool, on an adjustable crossbar of a waste stripping or blank separating station within a sheet processing machine, the fastening device comprising a rod-shaped tie bar provided with a headed end, said tie bar carrying successively a freely shiftable support with the support being freely engaged with the headed end of the tie bar, a first and second guide each being provided at least with one supporting surface slanted with regard to the axis of the tie bar and constructed to act jointly with two corresponding guide surfaces of the crossbar of the station, tightening means secured on the second end of the tie bar opposite the headed end and designed to push the sliding components toward the headed end of the tie bar in order to bring about a variation of their contact pressure enabling the execution, as required, of three operations, including fitting and dismantling the tool, shifting the tool and locking the tool in various positions with regard to one another on the crossbar. The improvements comprise the second guide having a shape of a jaw and being provided with a second slanted support surface which is opposite the first slanted support surface with regard to the axis of the tie bar and is designed to enter into contact with a second slanting support surface of the first guide in such a way as that when tightening takes place, a third support surface of the first guide will be shifted in a direction extending essentially perpendicular to the axis of the tie bar and be held in contact with a guide surface of the crossbar, both guides being provided with means for interlocking the rotary shifting one with regard to the other on the tie bar, the tightening means having three positions available, each being determined one with regard to the operation and a resilient element for receiving the force of the tightening means and for controlling the tightening strength being arranged between the action point of the tightening means and the second guide.

The solution suggested has the advantage of allowing an easy fit and holds every fastening device in a condition insuring the execution of one of the above-mentioned operations. On the other hand, it has been noted that it would be appropriate to have all the devices simultaneously in the same operative condition. This can easily be achieved by choosing the same position for the tightening means of all fastening devices. By way of principle, all these operations can be carried out with one hand quickly and without particular care and qualification or specific knowledge with a reliability rate equal, if not higher, than the earlier-stated art.

Other advantages and features of the invention will be readily apparent from the following description of the preferred embodiments, the drawings and claims.

DESCRIPTION OF THE PREFERRED EMBODIMENTS

Figure 1:
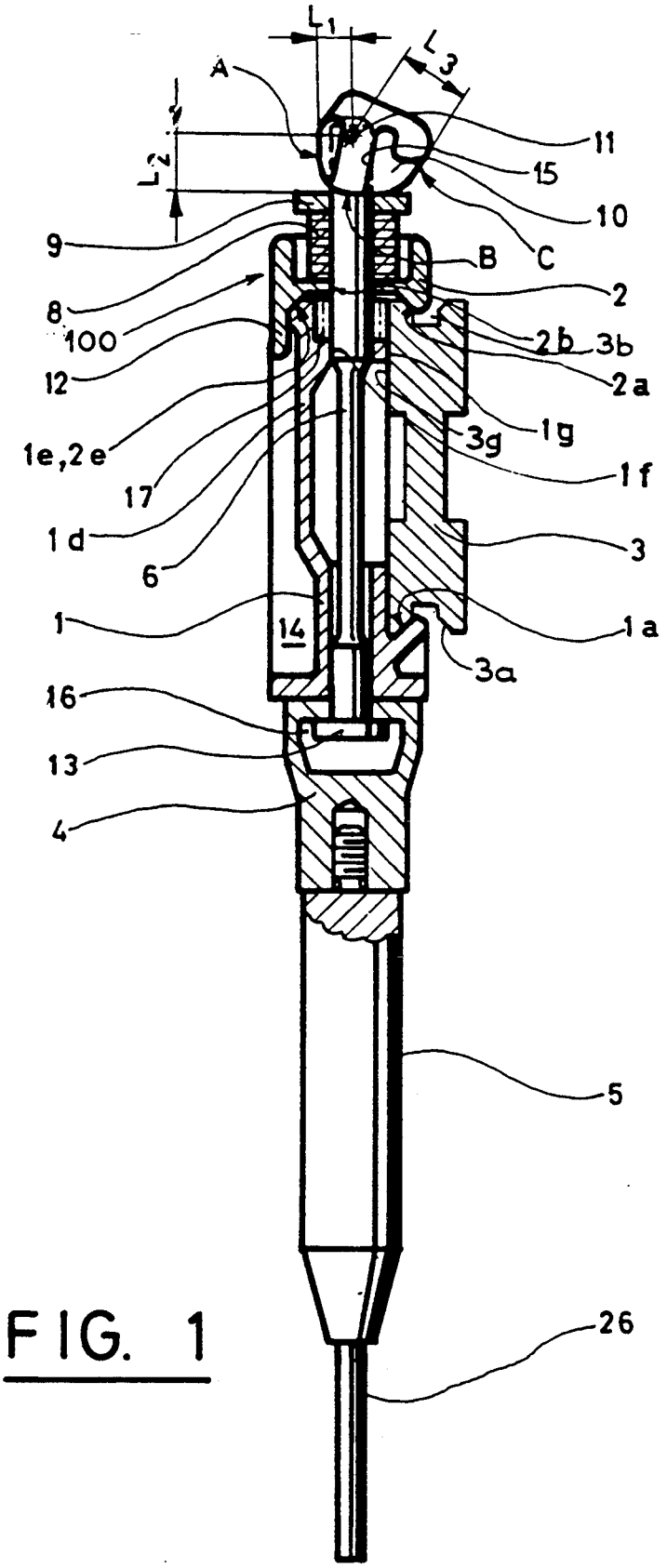
FIG. 1 represents a lengthwise cross sectional view with portions in elevation for purposes of illustration of the fastening device of the present invention held on a shiftable crossbar of a stripping station.
Figure 2:
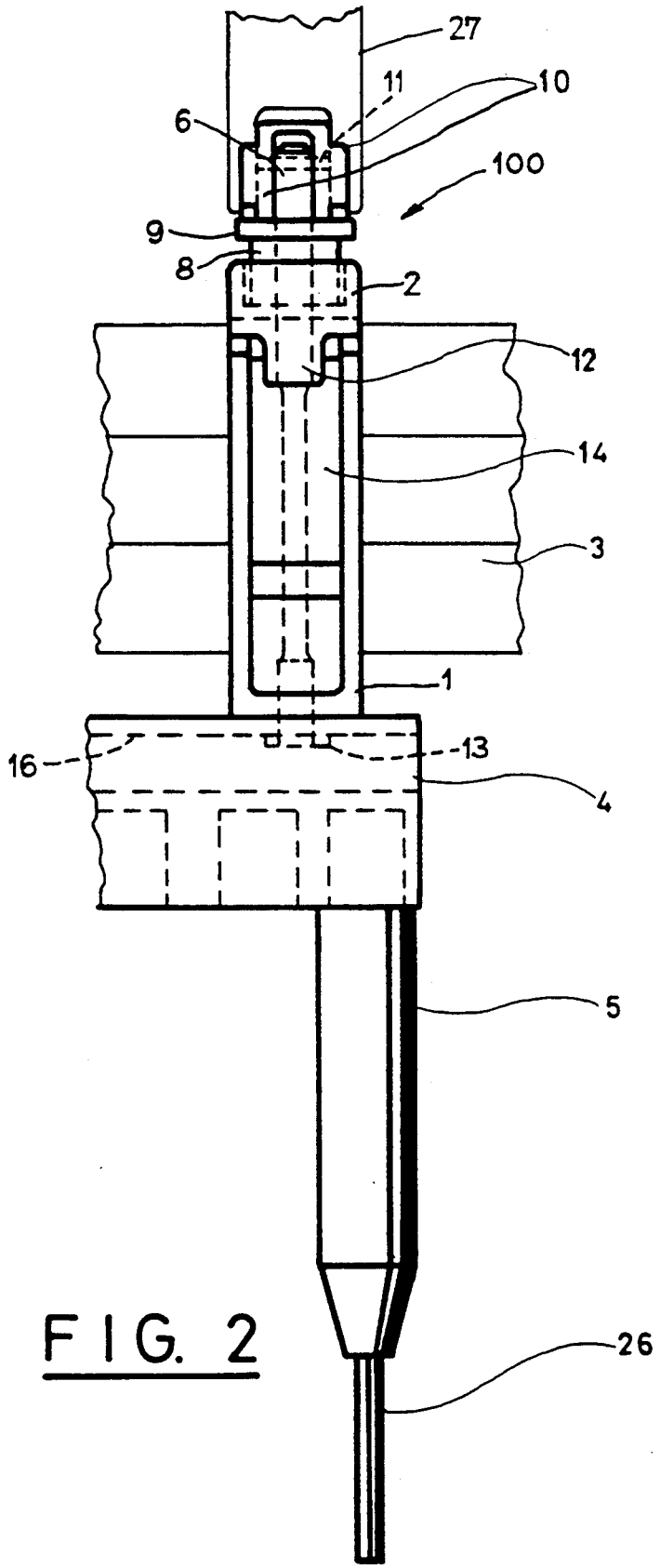
FIG. 2 represents a side view of the fastening device of FIG. 1.

The principles of the present invention are particularly useful when incorporated in a fastening device, generally indicated at 100 in FIGS. 1 and 2. The fastening device 100 is used to mount a tool, such as 5, having a stripping pin 26 (FIG. 2) on a crossbar 3 of a frame, such as illustrated in the above-mentioned U.S. Pat. No. 4,248,370, or as disclosed in U.S. Pat. No. 4,913,016, which is incorporated by reference thereto.

As illustrated in FIG. 1, the fastening device 100 includes a tie bar 6 shaped as a rod and provided with a headed end 13. The headed end 13 is received in a slot or T-shaped groove 16 of a support 4. The action of the head and slot 16 allows the support 4 to be shifted laterally relative to the axis of the tie bar 6 and also to be rotated around the axis. As illustrated, one or more stripping tools 5, which, as illustrated has a cylindrical base which supports the pin 26 for axial movement, is mounted on the support 4, such as by being threaded therein.

The fastening device also includes a first clamp or guide 1 and a second guide or clamp 2, which are both slidably received on the tie bar 6. Also slidably received on the tie bar 6 is a resilient element formed by resilient bushings 8 and a metal washer 9, as well as tightening means 10 which are fitted on the second end of the tie bar which is opposite the headed end 13.

The crossbar 3, as illustrated, has opposite edges with grooves 3*a* and 3*b*, which have a V-shape and provide slanting V-shaped surfaces. The first guide or clamp 1 has a first supporting surface 1*a* which extends parallel to the slanting surface of the guide or groove 3*a* of the bar 3. In a similar manner, the second guide 2 has a slanting surface 2*a* that extends substantially parallel to a slanting surface of the groove 3*b*. The clamp 1 comprises an extension 1*d* which extends along the tie bar 6 to a head portion having an aperture 1*f* for receiving the tie bar. The extension 1*d* also has a slanting supporting surface 1*e* which is destined to enter into contact with a second supporting surface 2*e* of the jaw or guide 2. The jaw or guide 2 is provided with a guiding dog 12 which is received within a groove 14 (FIG. 2) of the extension 1*d* of the guide 1 and the dog 12 and groove 14 act to limit relative rotation between the parts forming the guides 1 and 2. On the extension 1*d* (FIG. 1), the guide 1 has a third supporting surface 1*g* which extends essentially parallel to the tie bar 6 and is designed to form a contact with a guiding surface 3*g* of the crossbar 3.

The tightening means 10 of the tie bar 6 consist of a lever having the shape of a rotary cam 10 that is mounted by a rotary axle 11 of which is fitted permanently on the second end of the tie bar 6 and, in addition to this, extends perpendicular to the axis of the tie bar, as illustrated in FIGS. 1 and 2. The cam 10, as illustrated in FIG. 2, is composed of two identical parts which are parallel and symmetrically situated with regard to the axis of the tie bar 6. The active surfaces of every area of the cam 10 is to be in contact with a washer 9 and comprises three successive straight surface portions A, B and C (FIG. 1) linked to one another by rounded or curved surfaces. The distance from the rotary axis 11 of the part A is a distance $L_1$, while the distance of the part B is $L_2$ and the distance of part C is $L_3$ with the relationship being $L_1<L_2<L_3$. The cam can be rotated by means of a retractable or a non-retractable wrench 27 (FIG. 2), which is held within a groove 15 (FIG. 1) existing on the cam.

The purpose of the cam is to vary the contact pressure between the various components axially sliding on the tie bar 6 as well as between the support surfaces 1*a*, 2*a* and 1*g* of the guide 1 and guide 2 on the one hand, and the guiding surfaces of the crossbar 3 on the other hand, in order to enable the fastening device to achieve one or the other of the three operations mentioned hereinabove, which include fitting and dismantling the device, shifting of the device and locking of the device on the bar 3. If reference is made to FIG. 1, the function of the cam 10 is easy to understand. In fact, with the surface B in contact with the washer 9, the components referred to are slightly pressed against one another to a rate rendering a relative movement among them possible. The surface B, hence, corresponds to the shifting function. With the cam 10 rotated clockwise, the surface C will enter into contact with the washer 9. Since $L_3>L_2$, the washer is pushed toward the sliding components to render any additional shift impossible because of the contact pressure being considerably increased between these components. The surface C, thus, corresponds to the locking function. Ultimately, when the surface A, on account of a counter-clockwise rotation of the cam 10, comes into contact with the washer 9, due to the fact that the distance $L_1 < L_2 < L_3$, the washer 9 is to shift in the opposite direction with regard to the sliding component as far as to almost annul the contact pressure between the latter. In this position, one or the other of the components can be fitted or dismantled, dependent on the relative requirements. The surface A, thus, corresponds to the function of the fitting and dismantling position.

The purpose of the resilient bushing 8, which might, for instance, possibly be made of elastomers with a hardness of 95° Shore consists in checking the strength or force exerted by the cam 10 on the device in the sense that the length of the bushing 8 will vary proportionately with the compression strength applied. Moreover, the resilient bushing 8 will facilitate the shift of the cam 10 from one position to the other and ensure a backlash to be compensated. The resilient bushing 8 can be replaced by any other similar component, for example a plurality of spring washers. Between the extension 1*d* of the guide or clamp 1 and the jaw or guide 2, a compression spring 17 is fitted to surround the tie bar 6 for the purpose of urging the guides 1 and 2 apart from one another.

It has been noted that it would be appropriate to make the jaw or guide 2 from aluminum and the guide 1, as well as the support 4, from a plastic material in order to reduce the weight of the fastening device to a near minimum.

Obviously, numerous modifications may be added to the way of realizing the above-described fastening device without exceeding the framework of the present invention. Hence, the headed end 13 of the tie bar 6 could be provided as a nut which is engaged on threads provided on the bar 6 or any other component permanently fitted or retractably provided on the first end of the tie bar 6. The cam 10 used as a lever might have its rotary axle 11 provided in the perpendicular position with regard to the axis of the tie bar 6. Similarly, a kind of tightening lever different from the one of the cam might also be taken into consideration.

Similarly to the specialist, it is obvious that the fastening device described above in connection with the stripping tool may be used for fastening a pressing, a guiding, or a blank separation or a similar tool in a waste stripping or blank separation station.

Finally, the fact should also be pointed out that the fastening device described above perfectly overcomes the hazards involved with the diminishing pretension for the tightening of the clamp on the crossbar of a station referred to, which diminution is caused by the fitting of the device skewed on the crossbar owing to the resilient component 8 enabling the catching-up of the device besides maintaining the pretension at approximately its initial rate. Moreover, the hazards do not exist that the clamps are tightened excessively, since the tightening is automatically limited by the resilient element 8. This means that a material of lesser resistance or strength and, hence, of lighter weight can be used for the fastening device.

Although various minor modifications may be suggested by those versed in the art, it should be understood that I wish to embody within the scope of the patent granted hereon all such modifications as reasonably and properly come within the scope of my contribution to the art.

I claim:

1. In a device for fastening a tool on an adjustable crossbar of a waste stripping and blank separating station within a sheet processing machine, said fastening device comprising a rod-shaped tie bar provided with a headed first end, said tie bar carrying successively a freely shiftable support engageable with the headed end of the tie bar, first and second guides being provided at least with a first supporting surface extending at a slanting angle with regard to the axis of the tie bar and designed to act jointly with two corresponding guide surfaces of a crossbar of the station, tightening means fitted on a second end of the tie bar designed to push the guides toward the headed end of the tie bar in order to bring about a variation of the contact pressure thereby enabling the execution of a fitting and dismantling of the tool, a shifting of the fastening device and the tool relative to the crossbar and a locking of the tool in a desired position, the improvements comprising the second guide having a shape of a jaw and being provided with a second slanting support surface, said second slanting support surface being positioned opposite the first supporting surface of the second guide with regard to the axis of the tie bar and designed to enter into contact with a second slanted supporting surface of the first guide in such a way as when tightening takes place, a third supporting surface of the first guide will be shifted in a direction extending essentially perpendicular to the axis of the tie bar and will be held in contact with a guiding surface of the crossbar, both guides being provided with means for interlocking the rotary shifting of the first guide relative to the second guide on the tie bar, said tightening means having three cam surfaces, each being determined with regard to one of the above-mentioned operations, and resilient means for absorbing the tightening strength and controlling the tightening strength being arranged between an action point of the tightening means and the second guide.

2. In a device according to claim 1, wherein the headed first end of the tie bar is a permanent heading of the tie bar.

3. In a device according to claim 1, wherein the third supporting surface of the first guide is essentially parallel to the axis of the tie bar.

4. In a device according to claim 1, wherein a metal washer is interposed between the action point of the fastening means and the resilient means.

5. In a device for fastening a tool on an adjustable crossbar of a waste stripping blank separating station within a sheet processing machine, said fastening device comprising a rod-shaped tie bar provided with a headed first end, said tie bar carrying successively a freely shiftable support engageable with the headed end of the tie bar, first and second guides being provided at least with a first supporting surface extending at a slanting angle with regard to the axis of the tie bar and designed to act jointly with two corresponding guide surfaces of a crossbar of the station, tightening means fitted on a second end of the tie bar designed to push the guides toward the headed end of the tie bar in order to bring about a variation of the contact pressure thereby enabling the execution of a fitting and dismantling of the tool, a shifting of the fastening device and the tool relative to the crossbar and a locking of the tool in a desired position, the improvements comprising the second guide having a shape of a jaw and being provided with a second slanting support surface, said second slanting support surface being positioned opposite the first supporting surface of the second guide with regard to the axis of the tie bar and designed to enter into contact with a second slanted supporting surface of the first guide in such a way as when tightening takes place, a third supporting surface of the first guide will be shifted in a direction extending essentially perpendicular to the axis of the tie bar and will be held in contact with a guiding surface of the crossbar, both guides being provided with means for interlocking the rotary shifting of the first guide relative to the second guide on the tie bar, and resilient means for absorbing the tightening strength and controlling the tightening strength being arranged between an action point of the tightening means and the second guide, the tightening means comprising a lever shaped as a rotary cam, the rotary axis of said cam being perpendicular to the axis of the tie bar, said cam being fitted permanently on the tie bar with active surfaces of the cam including three straight parts interconnected by rounded parts with the first of said straight parts having a distance $L_1$ from the rotary axis, the second of said straight parts having a distance $L_2$ from the rotary axis, and the third straight part having a distance $L_3$ from the rotary axis, said distances having the relationship $L_1<L_2<L_3$, said tightening means being designed in such a way that rotation of the cam from one position to the other, the resilient element will be subjected to lengthening and shortening proportional to the differences between the two distances of the surfaces being changed, wherein rotation of the cam will cause variations in the contact pressure in proportion to the differences between the various distances so that the distance $L_1$ corresponds to the function of fitting and dismantling, the distance $L_2$ corresponds to the function of shifting the tool and the distance of $L_3$ corresponds to the function of locking the tool in the selected position.

6. In a device according to claim 5, wherein the lever is composed of two identical cams situated symmetrically relative to the axis of the tie bar.

7. In a device according to claim 6, wherein the third supporting surface of the first guide is essentially parallel to the axis of the tie bar.

8. In a device according to claim 6, which includes a metal washer being interposed between the action point of the cams and the resilient means, which is constructed as an elastomer bushing surrounding the tie bar.

9. In a device according to claim 6, wherein the first supporting surface of the first guide has a V-shaped profile.

10. In a device according to claim 6, which includes a compression spring being interposed between the two guides to urge the two guides apart along the axis of the tie bar.

11. In a device according to claim 6, wherein the headed first end of the tie bar is held in a T-shaped groove of the tool support in such a way to enable rotary and longitudinal movement of the support relative to the first guide and tie bar.

* * * * *